US007233309B2

(12) United States Patent
Diefenbaugh et al.

(10) Patent No.: US 7,233,309 B2
(45) Date of Patent: Jun. 19, 2007

(54) COORDINATING BACKLIGHT FREQUENCY AND REFRESH RATE IN A PANEL DISPLAY

(75) Inventors: Paul S. Diefenbaugh, Beaverton, OR (US); David Wyatt, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 556 days.

(21) Appl. No.: 10/678,027

(22) Filed: Sep. 30, 2003

(65) Prior Publication Data

US 2005/0068289 A1 Mar. 31, 2005

(51) Int. Cl.
*G09G 3/36* (2006.01)

(52) U.S. Cl. ..... 345/102; 345/207

(58) Field of Classification Search ..... 345/102, 345/691, 207, 690
See application file for complete search history.

(56) References Cited

U.S. PATENT DOCUMENTS 6,426,736 B1 * 7/2002 Ishihara ..... 345/102
6,831,621 B2 * 12/2004 Nakano ..... 345/87
6,980,225 B2 * 12/2005 Funamoto et al. ..... 345/691

* cited by examiner

*Primary Examiner*—Richard Hjerpe
*Assistant Examiner*—Jean Lesperance
(74) *Attorney, Agent, or Firm*—Alan Pedersen-Giles

(57) ABSTRACT

A panel may be arranged to display image data, and a backlight may be arranged to illuminate a back of the panel. A timing generator may be arranged to control the refresh rate of the panel, and a modulator may be arranged to control the backlight based on an associated modulation frequency. A coordinator may be arranged to synchronize between the refresh rate and the modulation frequency when the refresh rate or the modulation frequency is changed.

12 Claims, 4 Drawing Sheets

COORDINATING BACKLIGHT FREQUENCY AND REFRESH RATE IN A PANEL DISPLAY

BACKGROUND

1. Field of the Invention

The claimed invention relates to computer displays and, more particularly, to panel displays.

2. Description of Related Art

Panel displays (e.g., LCD panels) have been used more and more in conjunction with computers. Such panel displays may use less power and may exhibit less flicker than, for example, cathode ray tube (CRT) displays. When used in notebook (or "laptop") computers, however, panel displays may still consume a relatively large percentage of the notebook computer's total power. Accordingly, various schemes have been proposed to reduce power consumption by such panel displays.

One exemplary scheme for reducing power consumption may be to dim the backlight of the panel display, resulting in less power consumed in the backlight, control and drive circuits. In another scheme the panel refresh rate may be decreased, resulting in lower power consumption from reduced display bandwidth requirements, and decreased panel logic and drive circuitry. When using these and/or other power saving techniques, however, visual artifacts may irritate a user and cause the user to disable the power saving scheme. When a user disables the power saving scheme, this may reduce the operational time between battery charges of the notebook computer.

Thus, there is a need in the art to reduce power consumption by panel displays while avoiding visually disturbing display artifacts.

BRIEF DESCRIPTION OF THE DRAWINGS

The accompanying drawings, which are incorporated in and constitute a part of this specification, illustrate one or more implementations consistent with the principles of the invention and, together with the description, explain such implementation(s). In the drawings.

DETAILED DESCRIPTION

The following detailed description refers to the accompanying drawings. The same reference numbers may be used in different drawings to identify the same or similar elements. Also, the following detailed description illustrates certain implementations and principles, but the scope of the claimed invention is defined by the appended claims and equivalents.

EXEMPLARY SYSTEM

Figure 1:
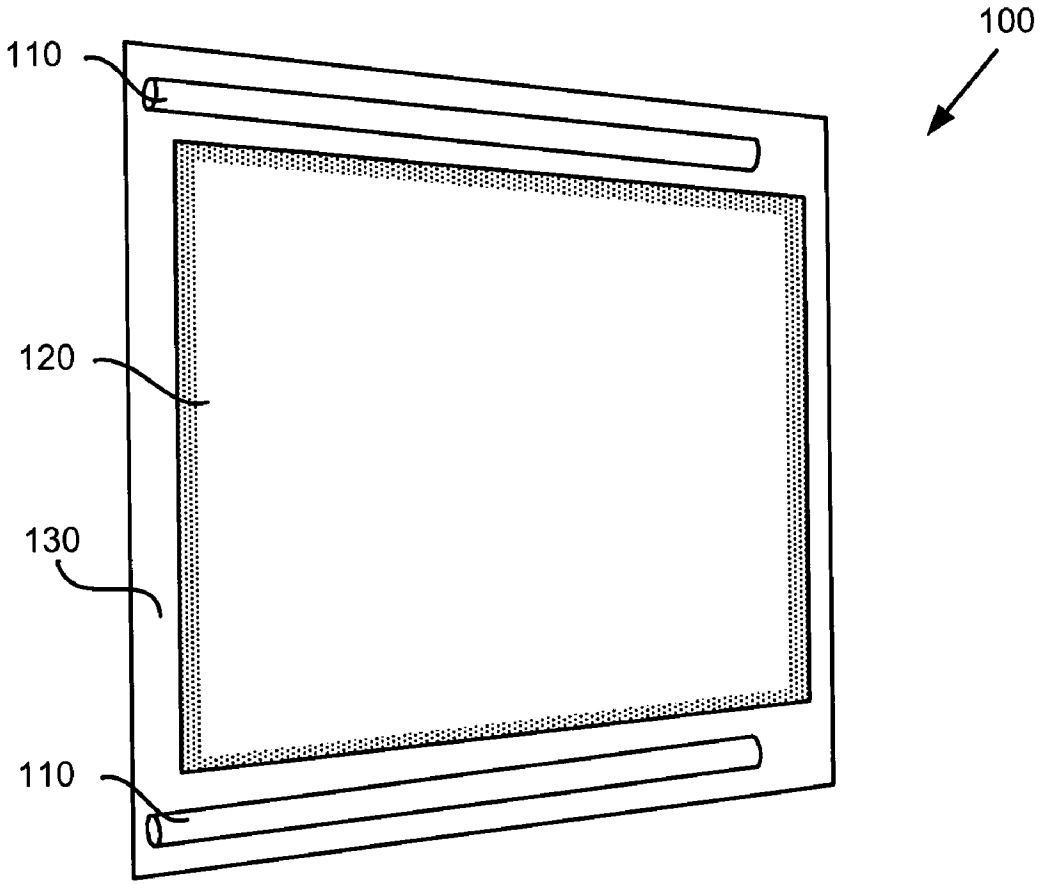
FIG. 1 is an isometric view of a panel display that may be used in an implementation consistent with the principles of the invention.

FIG. 1 is a schematic diagram of an isometric view of a panel display 100 that may be used in an implementation consistent with the principles of the invention. Panel display 100 may include one or more backlights 110, a panel 120, and a light spreader 130. Backlight(s) 110 may include, for example, a cold cathode fluorescent tube. In other implementations, backlight(s) 110 may include one or more light emitting diodes (LEDs), which may be driven in a typical manner. Backlight(s) 110 may be located behind and above/below panel 120 to provide illumination to the rear of panel 120.

Panel 120 may include, for example, a liquid crystal display (LCD) panel that is arranged to display an image that is illuminated by backlight(s) 110. Other types of backlit panels may also be used in implementations consistent with the principles of the invention. Light spreader 130 may be arranged substantially behind backlight(s) 110, and may also extend above/below backlight(s) 110, to direct their light to the rear of panel 120. Light spreader 130 may reflect and/or diffuse light from backlight(s) 110 to illuminate panel 120 substantially uniformly along its surface.

Figure 2:
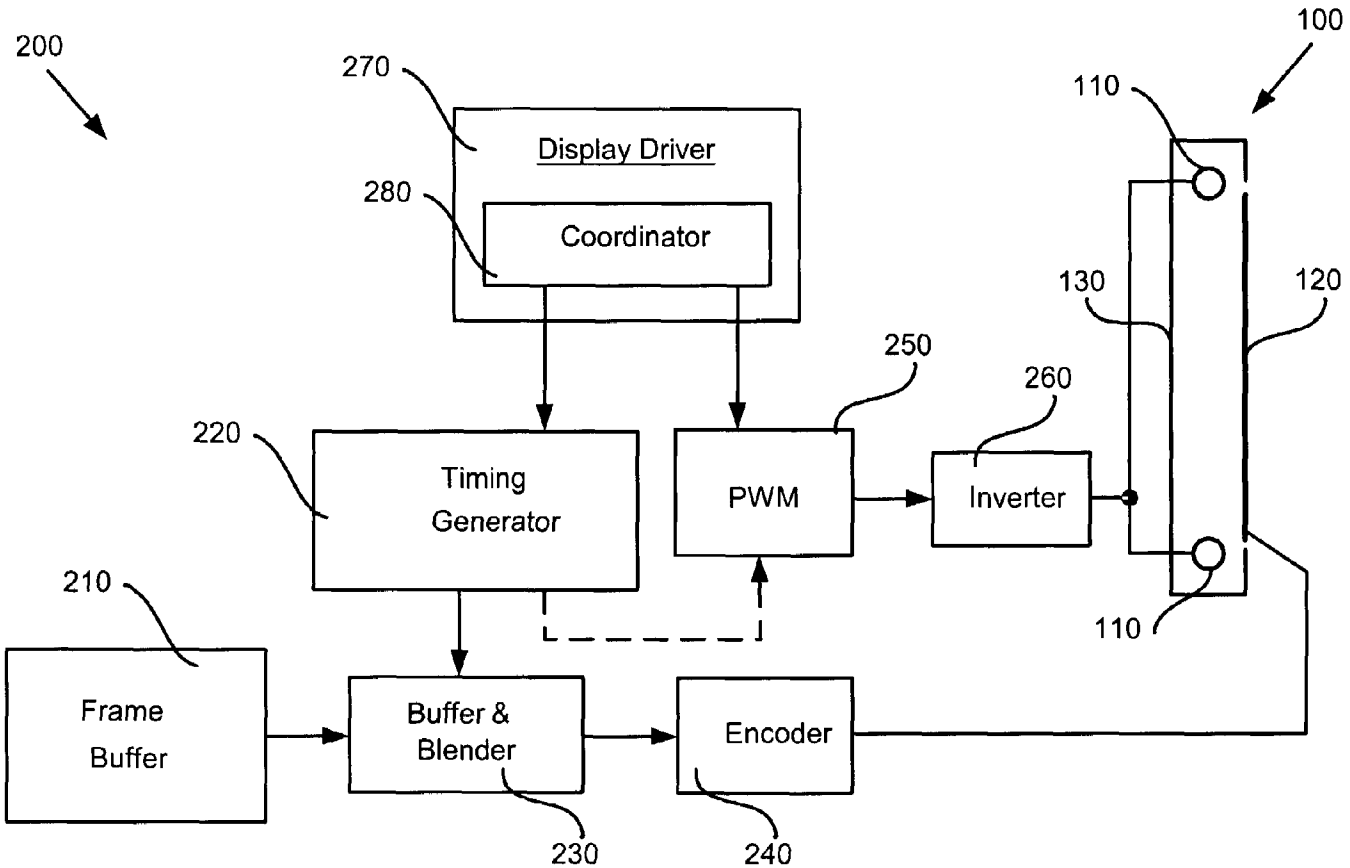
FIG. 2 illustrates an exemplary implementation of a panel display system according to an implementation consistent with the principles of the invention.

FIG. 2 illustrates an exemplary implementation of a panel display system 200 according to an implementation consistent with the principles of the invention. Panel display system 200 may be implemented in one of a number of devices.

Figure 3:
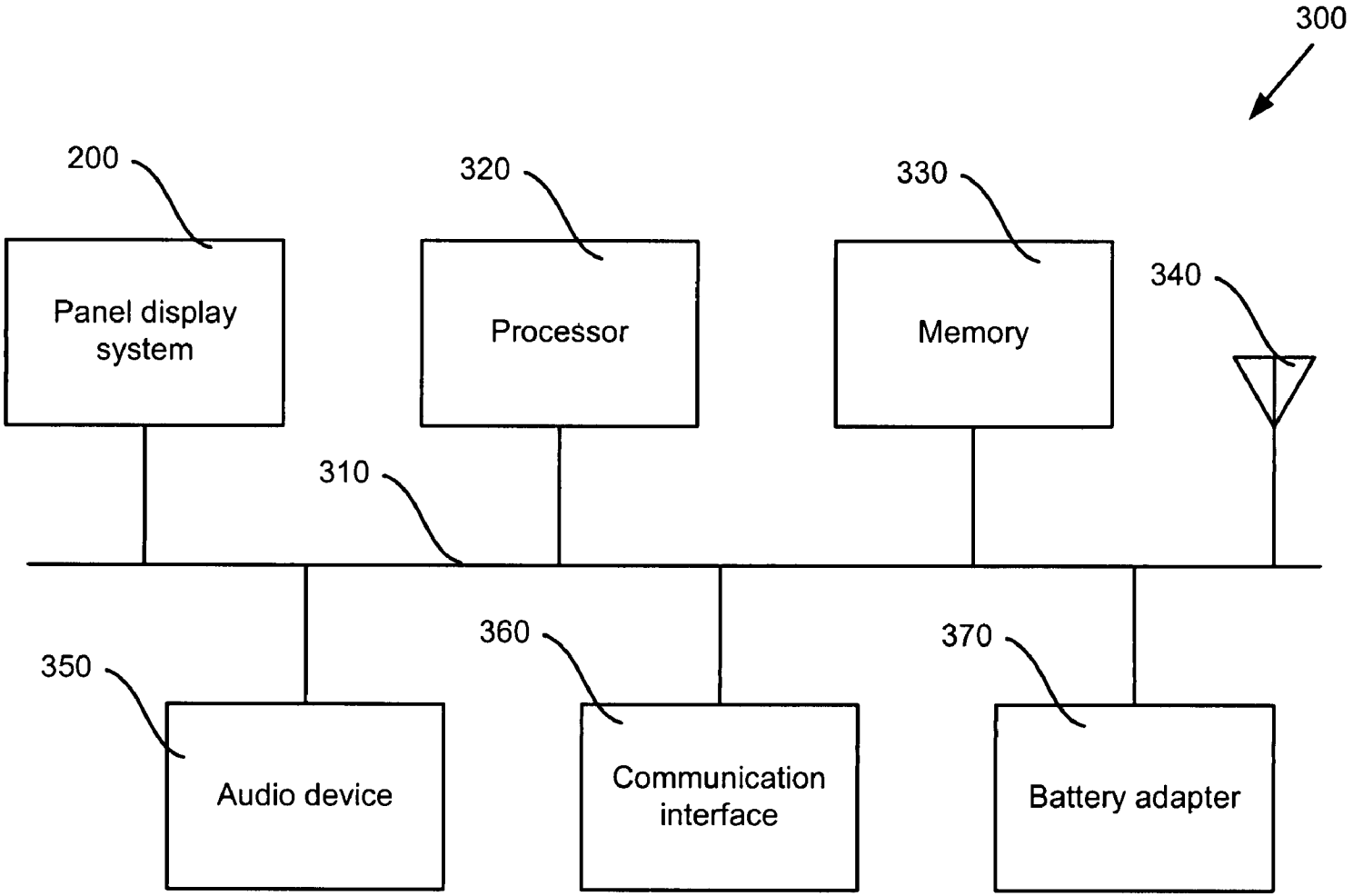
FIG. 3 illustrates an exemplary system that may include the panel display system of FIG. 2 according to an implementation consistent with the principles of the invention.

FIG. 3 illustrates an exemplary system 300 that may include panel display system 200. System 300 may include a notebook computer, a stand-alone display, and/or an integrated display on some device other than a notebook computer. In addition to panel display system 200, system 300 may also include one or more of bus(es) 310, a processor 320, a memory 330, an antenna 340, an audio device 350 (e.g., a speaker, audio output port, microphone, and/or audio input port), a communication interface 360 (e.g., a universal serial bus (USB) port and/or Ethernet port), and/or battery adapter 370. System 300 may include only certain ones of elements 310–370 illustrated in FIG. 3. If, for example, system 300 includes a notebook computer, it may include antenna 340 and/or battery adapter 370, but if system 300 includes a stand-alone display, it may not include an antenna 340 and/or battery adapter 370.

Returning to FIG. 2, panel display system 200 may include panel display 100, a frame buffer 210, a timing generator 220, a buffer and blender 230, an encoder 240, a pulse width modulator (PWM) 250, an inverter 260, and a display driver 270. In various implementations, two or more of elements 210–270 may be integrated within a single device. By way of example, a pixel buffer, display timing generator 220, blender 230, and panel encoder 240 may be integrated within a graphics controller, with or without PWM 250. Such a graphics controller may be located in a system component chip, or integrated within a system controller chip such as the memory controller hub (MCH), or on an add-in adapter card. Other combinations of integrated and discrete elements, however, are possible and contemplated for panel display system 200. Further, the functionality of elements 210–270 may be implemented in hardware, software, or some combination of hardware and software.

Frame buffer 210, timing generator 220, buffer and blender 230, and encoder 240 may cooperate to drive panel 120 in panel display 100. Frame buffer 210 may include a memory and may be arranged to store one or more frames of graphics data to be shown on panel 120.

Timing generator 220 may be arranged to generate a refresh signal to control the refresh rate (e.g., frequency of refresh) of panel 120. Timing generator 220 may produce the refresh signal in response to a control signal from display driver 270. In some implementations, the refresh signal produced by timing generator 220 may cause panel 120 to be refreshed at a reference refresh rate (e.g., 60 Hz) during typical (e.g., non-power saving) operation. During power saving operation, timing generator 220 may lower refresh rates for panel display 110 (e.g., to 50 Hz, 40 Hz, 30 Hz, etc.).

Buffer and blender 230 may read graphics data (e.g., pixels) from frame-buffer 210 in graphics memory at the refresh rate (e.g., 60 Hz or lower) specified by the refresh signal from timing generator 220. Buffer and blender 230 may blend this graphics data (e.g. display planes, sprites, cursor and overlay) and may also gamma correct the graphics data. Buffer and blender 230 also may output the blended display data at the refresh rate (e.g., 60 Hz or lower). In one implementation, buffer and blender 230 may include a first-in first-out (FIFO) buffer to store the graphics data before transmission to encoder 240.

Encoder 240 may encode the graphics data output by buffer and blender 230 for display on panel 120. Where panel 120 is an analog display, encoder 240 may use a low voltage differential signaling (LVDS) scheme to drive panel 120. In other implementations, if panel 120 is a digital display, encoder 240 may use another encoding scheme that is suitable for this type of display. Because encoder 240 may receive data at the rate output by buffer and blender 230, encoder may refresh panel 120 at the refresh rate (e.g., 60 Hz or lower) specified by the refresh signal from timing generator 220.

PWM 250 and inverter 260 may cooperate to drive backlight(s) 110 in panel display 100. PWM 250 may be arranged to output a PWM signal that has a modulation frequency and a duty cycle. In some implementations, the duty cycle setting of the PWM 250 may be varied by display driver 270 to dim the light output by backlight(s) 110. PWM 250 may be arranged to output the PWM signal to inverter 260 at a reference modulation frequency (e.g., 60 or 200 Hz) during typical (e.g., non-power saving) operation.

In one implementation, PWM 250 may receive a timing signal from timing generator 220 and may derive its base frequency from this timing signal, upon which the output duty cycle is modulated according to a PWM interface setting value. Such an implementation is illustrated by the dashed line in FIG. 2 from timing generator 220 to PWM 250. In other implementations, however, PWM 250 may include its own, separate, timing generator for use in deriving its reference clock. In either case, the modulation frequency of PWM 250 may be adjusted (e.g., lowered during a power saving mode) by display driver 270.

Inverter 260 may be arranged to receive the PWM signal at the modulation frequency from PWM 250 and to drive backlight(s) 110 based on the modulation frequency of the PWM signal. Inverter 260 may produce an output whose "backlight frequency" is a multiple of the modulation frequency of the received PWM signal from PWM 250. In one implementation, the backlight frequency of the output of inverter 260 may be substantially the same frequency (i.e., a multiple of one) as the PWM signal. In other implementations, inverter 260 may be arranged to effect a higher multiple of the modulation frequency, producing an output signal with a backlight frequency that may vary from, for example, 200 Hz to 60 kHz.

Display driver 270 may be arranged to control one or both of timing generator 220 and PWM 250. In a power saving mode, display driver 270 may lower the refresh rate of panel 120 by controlling timing generator 220 so that panel 120 consumes less power. Display driver 270 may receive a signal to enter the power saving mode from, for example, processor 320 via a control line (not shown).

One way of reducing power consumption of system 200 may be to reduce the refresh rate via timing generator 220 without regard to the modulation frequency of PWM 250. Such a scheme may, or may not, adjust the modulation frequency of PWM 250, but in either case the refresh rate produced by timing generator 220 may not be coordinated with the modulation frequency of PWM 250.

Lowering the refresh rate of panel 120 without coordinating with PWM 250, however, may produce a "beat frequency" (e.g., from an additive mismatch between the refresh rate of panel 120 and the backlight frequency of backlight(s) 110). The beat frequency may be defined as the absolute value of the modulation frequency of PWM 250 minus the refresh rate produced by timing generator 220. In certain situations (e.g., when the beat frequency is mismatched to the refresh rate of panel 120), this beat frequency may produce visually disturbing artifacts, such as a "waterfall effect" where the intensity of backlight(s) 110 may appear unevenly distributed and/or cascading along panel 120. These disturbing artifacts may influence a user to disable the power saving mode for panel display 100.

Accordingly, in one implementation consistent with the principles of the invention, display driver 270 may include a coordinator 280 that is arranged to coordinate the refresh rate of timing generator 220 (and panel 120) and the modulation frequency of PWM 250 (that is related to the backlight frequency of backlight(s) 110). Coordinator 280 may be implemented by hardware, software, or some combination of hardware and software within display driver 270. If coordinator 280 is implemented via software and/or firmware, computer executable instructions to perform its functionality may be stored in a memory (not shown), possibly within display driver 270. Coordinator 280 may be arranged to coordinate between timing generator 220 and PWM 250 in one of two modes. In so coordinating, coordinator 280 may be arranged to perform calculations and/or perform look-ups in a memory (not shown).

In a first coordination mode, coordinator 280 may ensure that the modulation frequency of PWM 250 is an integer multiple of the refresh rate associated with timing generator 220 (or vice versa). For example, for a refresh rate of 50 Hz, the modulation frequency of PWM 250 may be set to 50 Hz, 100 Hz, 150 Hz, 200 Hz, 250 Hz . . . etc. Hence, any resultant beat frequency may be "matched" with (e.g., be an integer multiple of) the refresh rate. It should be noted that coordinator 280 also may coordinate between PWM 250 and timing generator 220 non-power saving modes of operation (e.g., typical or reference modes), as well as power-saving modes. By maintaining an integer multiple relationship between the refresh rate of panel 120 and the backlight frequency of backlight(s) 110 (which is related to the modulation frequency of PWM 250 in a predetermined manner), coordinator 280 may substantially avoid a mismatched beat frequency and its associated artifacts.

In a second coordination mode, coordinator 280 may ensure that a mismatched beat frequency between the backlight frequency of backlight(s) 110 (derived from the modulation frequency of PWM 250) and the refresh rate of panel 120 (from timing generator 220) is too high to be visually apparent. For a given refresh rate by timing generator 220, for example, coordinator 280 may set the modulation frequency of PWM 250 so that the mismatched (e.g., non-integer multiple of the refresh rate) beat frequency between the backlight frequency and the refresh rate may be about 100 Hz, 200 Hz, 300 Hz, or higher.

By maintaining a mismatched beat frequency between the refresh rate of panel 120 and the backlight frequency of backlight(s) 110 (which is related to the modulation frequency of PWM 250) that is too high for a user's eyes to perceive, coordinator 280 may avoid the undesirable effects of the beat frequency. For example, a user may not wish to disable the power saving mode if unable to see the beat frequency artifact in panel 120. In contrast to the first coordination mode, the second coordination mode may permit more inaccuracy when coordinating between PWM 250 and timing generator 220, as long as the beat frequency remains too high to be perceived (e.g., greater than about 200 Hz).

In some implementations, the first coordination mode may be preferred to the second coordination mode, because a higher modulation frequency of PWM 250 may produce more energy in electromagnetic interference (EMI). Further, the second coordination mode may, in some instances, produce lower frequency standing waves (e.g., beat frequencies) that may appear as uneven variations in the brightness of panel 120. In some implementations, the first coordination mode may fix the relationship (e.g., phase) between the modulation frequency of PWM 250 and the refresh rate associated with timing generator 220 so that any standing waves present may occur within the blank interval associated with panel 120.

EXEMPLARY PROCESS

Figure 4:
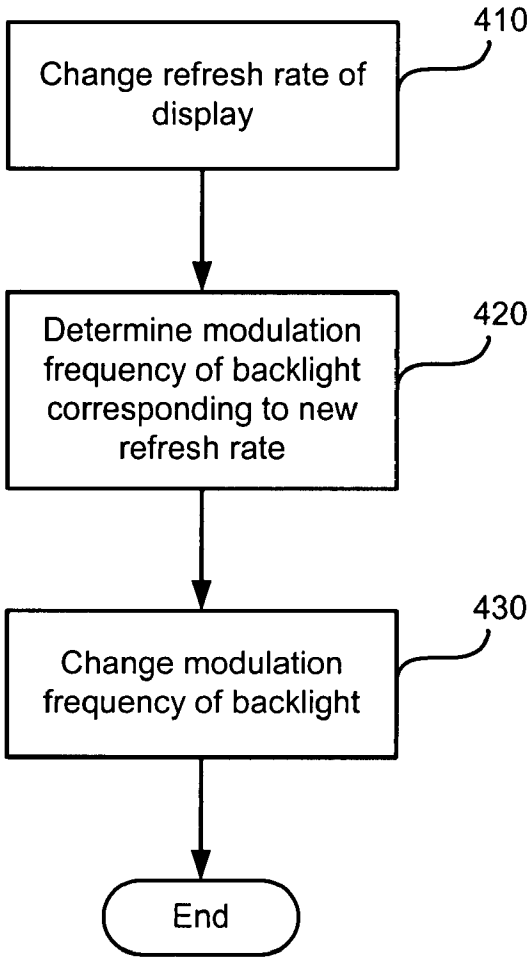
FIG. 4 is a flow chart illustrating a process of coordinating refresh rate and backlight frequency according to an implementation consistent with the present invention.

FIG. 4 is a flow chart illustrating a process of coordinating refresh rate and backlight frequency according to an implementation consistent with the present invention. The process may begin by setting up the Graphics Controllers' timing generator 220 to change the refresh rate of panel 120 to a new refresh rate in panel display 100 [act 410]. In one implementation, act 410 may be performed to decrease the refresh rate to the new, lower, refresh rate to save power in system 200. In another implementation, however, act 410 may be performed to initially set the reference refresh rate, for example during initialization of system 200. Act 410 may also be performed when raising the refresh rate, for example, when entering a higher performance mode.

The process may continue with coordinator 280 (or some other portion of display driver 270) determining a modulation frequency for backlight(s) 110 (via PWM 250) that corresponds to the new refresh rate [act 420]. In some implementations, the modulation frequency for PWM 250 may be calculated using a predetermined formula or relationship (e.g., multiply the refresh rate by some integer or other number). In other implementations, the modulation frequency for PWM 250 may be obtained from a look-up table containing modulation frequencies that correspond to certain panel refresh rates.

Depending on the particular implementation chosen, act 420 may determine a modulation frequency for PWM 250 that produces no beat frequency with the refresh rate of timing generator 220. In certain implementations, however, act 420 may determine a modulation frequency that produces a beat frequency that is too high to be noticed by a user.

Coordinator 280 may alter the frequency of backlight(s) 110 in accordance with the modulation frequency determined in act 420 [act 430]. Coordinator 280 may output a control signal to PWM 250 to change the modulation frequency of the PWM signal output by PWM 250 as determined in act 420. This changed modulation signal may result in a desired beat frequency (e.g., a matched beat frequency or a relatively high mismatched one) between the backlight frequency of backlight(s) 110 and the refresh rate of panel 120.

CONCLUSION

The foregoing description of one or more implementations consistent with the principles of the invention provides illustration and description, but is not intended to be exhaustive or to limit the claimed invention to the precise form disclosed. Modifications and variations are possible in light of the above teachings or may be acquired from practice of the invention.

For example, although described as higher in some implementations, the modulation frequency of PWM 250 need not necessarily be higher than the refresh rate associated with timing generator 220. If inverter 260 multiplies the modulation frequency from PWM 250 by a relatively large number, for example, the modulation frequency of PWM 250 may be less than or equal to the refresh rate of panel 120. Also, although FIG. 4 describes adjusting the PWM modulation frequency based on a changed refresh rate, in other implementations the refresh rate may be adjusted based on a changed PWM modulation frequency. Further, if LEDs are used for backlight(s) 110, inverter 260 may be replaced by suitable driving circuitry for the LEDs and/or may be omitted.

Moreover, the acts in FIG. 4 need not be implemented in the order shown; nor do all of the acts necessarily need to be performed. Also, those acts that are not dependent on other acts may be performed in parallel with the other acts. Further, the acts in this figure may be implemented as instructions, or groups of instructions, in a computer-readable medium.

No element, act, or instruction used in the description of the present application should be construed as critical or essential to the invention unless explicitly described as such. Also, as used herein, the article "a" is intended to include one or more items. Where only one item is intended, the term "one" or similar language is used. The scope of the claimed invention is defined by the claims and their equivalents.

What is claimed:

1. A method of controlling a display that includes a backlight, comprising:

changing an original refresh rate of the display to a new refresh rate;

determining a desired modulation frequency for the backlight based on the new refresh rate of the display; and adjusting a frequency of the backlight to the desired modulation frequency, wherein the determining includes:

obtaining the desired backlight frequency so that a beat frequency between the desired backlight frequency and the new refresh rate is too high to be visually perceived by a user of the display.

2. The method of claim 1, wherein the changing includes:

lowering the refresh rate of the display to the new refresh rate that is different than the original refresh rate.

3. The method of claim 1, wherein the determining includes:

obtaining the desired backlight frequency that is a multiple of the new refresh rate.

4. The method of claim 1, wherein the determining includes:

ascertaining a desired modulation frequency for a modulator connected to the backlight that will produce the desired backlight frequency for the backlight.

5. The method of claim 4, wherein the adjusting includes:

controlling the modulator to produce the desired modulation frequency.

6. A system, comprising:

a panel to display image data thereon;

a backlight to illuminate a rear of the panel;

a timing generator to control a refresh rate of the panel;

a modulator to control the backlight based on an associated modulation frequency;

a coordinator to coordinate between the refresh rate and the modulation frequency when the refresh rate or the modulation frequency is changed; and an antenna proximate the panel, wherein the coordinator is arranged to control the timing generator and the modulator to result in a beat frequency between the refresh rate and the modulation frequency being too high to be visually detected by a user of the system.

7. The system of claim 6, further comprising:

an audio device proximate the panel.

8. The system of claim 6, further comprising:

a communication interface proximate the panel.

9. A system, comprising:

a panel to display image data thereon;

a backlight to illuminate a rear of the panel;

a timing generator to control a refresh rate of the panel;

a modulator to control the backlight based on an associated modulation frequency;

a coordinator to coordinate between the refresh rate and the modulation frequency when the refresh rate or the modulation frequency is changed; and an antenna proximate the panel, wherein the coordinator is arranged to control the timing generator and the modulator to result in one of the refresh rate and the modulation frequency being a multiple of another of the refresh rate and the modulation frequency.

10. A system, comprising:

means for controlling a refresh rate of a panel;

means for adjusting an operational frequency of a backlight; and means for coordinating between the means for controlling and the means for adjusting to substantially avoid a beat frequency between the refresh rate and the operational frequency that is visually perceptible by a user of the system.

11. The system of claim 10, wherein the means for coordinating further coordinates between the means for controlling and the means for adjusting to substantially match the beat frequency and the refresh rate.

12. The system of claim 10, wherein the means for coordinating further coordinates between the means for controlling and the means for adjusting so that the beat frequency is too high to be visually perceived by the user of the system.

* * * * *